United States Patent [19]

Holz

[11] 4,146,428

[45] Mar. 27, 1979

[54] SUCTION ROLL FOR PAPER MACHINES

[75] Inventor: Emil Holz, Eningen, Fed. Rep. of Germany

[73] Assignee: Hermann Finckh Maschinenfabrik, Pfullingen, Fed. Rep. of Germany

[21] Appl. No.: 840,376

[22] Filed: Oct. 7, 1977

[30] Foreign Application Priority Data

Oct. 13, 1976 [DE] Fed. Rep. of Germany ..... 2646116

[51] Int. Cl.[2] ..... D21F 1/60; D21F 3/10

[52] U.S. Cl. ..... 162/372; 162/357

[58] Field of Search ..... 162/372, 374, 357, 368, 162/369; 210/402, 497 R; 29/121.3

[56] References Cited

U.S. PATENT DOCUMENTS

| | | | |
|---|---|---|---|
| 2,069,119 | 1/1937 | Standley et al. | 162/372 |
| 3,105,043 | 9/1963 | Rich et al. | 210/402 |
| 3,139,375 | 6/1964 | Bryand | 162/372 X |
| 3,755,869 | 9/1973 | Aurich | 29/121.3 |
| 3,773,614 | 11/1973 | Pennington | 162/372 X |

FOREIGN PATENT DOCUMENTS

| | | | |
|---|---|---|---|
| 495535 | 11/1938 | United Kingdom | 162/374 |

*Primary Examiner*—Richard V. Fisher
*Attorney, Agent, or Firm*—Kenway & Jenney

[57] ABSTRACT

A suction roll, for a paper-making machine having a hollow cylindrical roll shell with a cylindrical inner surface from which a suction box draws water, has members inserted into the roll shell openings. The insert members are apertured with radially-extending ducts for the suction of water to the roll shell inner surface. The insert members form a major portion of the shell inner surface and characterize that surface for relatively low-wear sealing with a suction box movable relative to the roll shell.

10 Claims, 5 Drawing Figures

Figure 3:
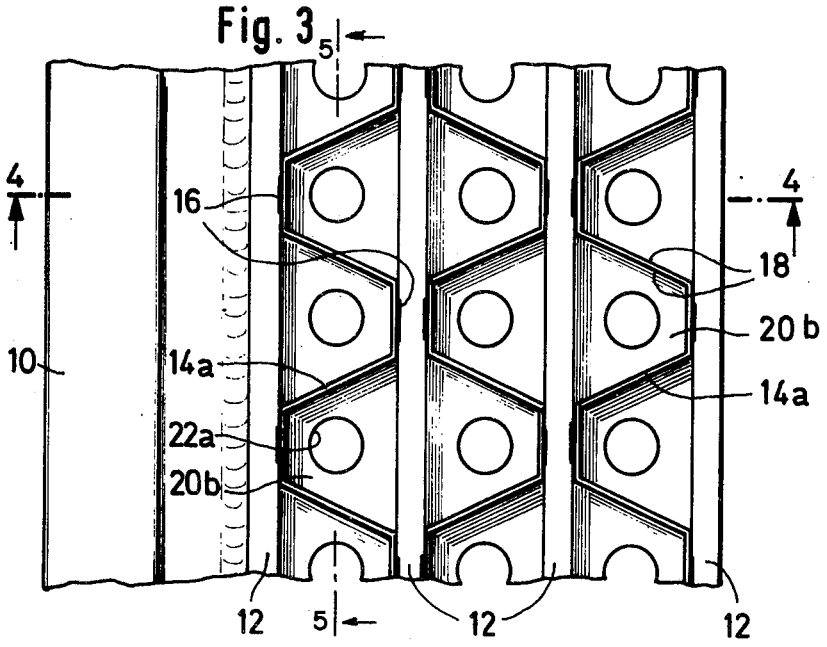

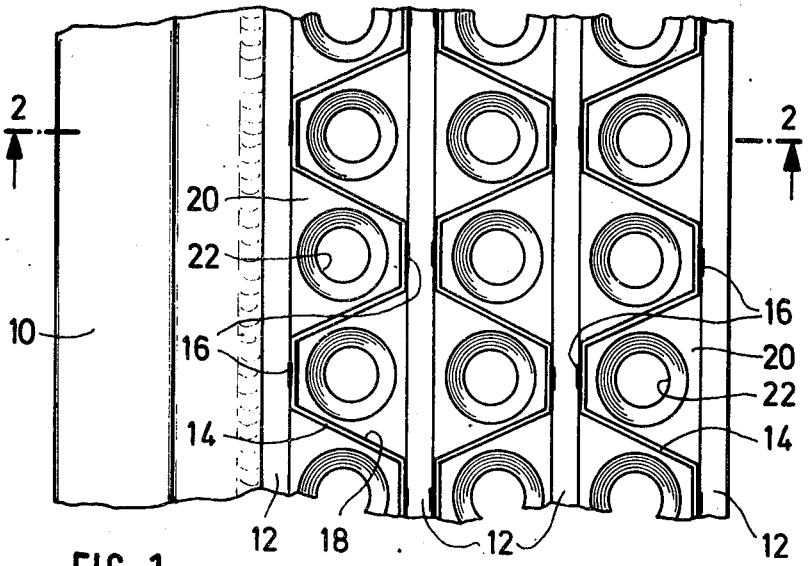
FIG. 1
Fig. 2
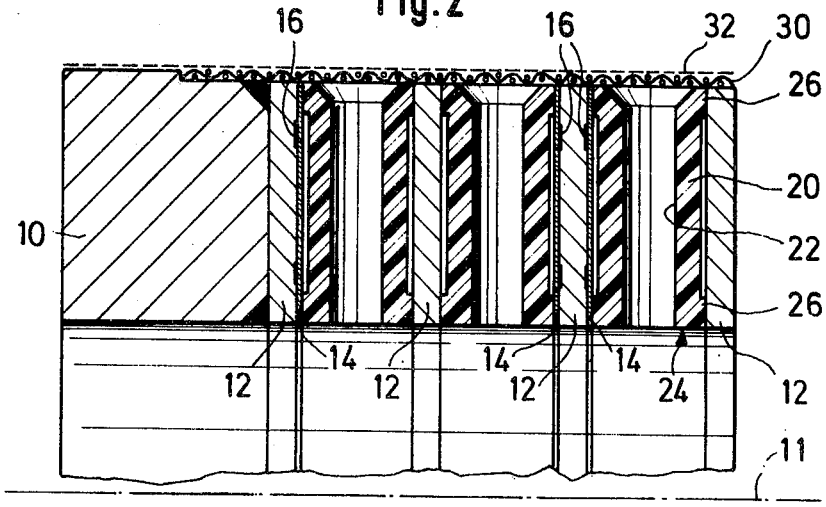

SUCTION ROLL FOR PAPER MACHINES

The invention relates to a suction roll for paper machines or the like having a hollow-cylindrical shell which, in a plan view, comprises a grid structure and which has a circular-cylindrical inner surface. Such suction rolls are suitable also for machines used in the production of card board, machines for dewatering cellulose and similar.

As shown e.g. by U.S. Pat. Nos. 3,139,375 and 3,105,043, it is usual to form the grid structure of hollow-cylindrical roll shells by means of sheet metal strips disposed upright on one edge which are all either corrugated or are alternately of straight and corrugated construction — along a surface line of the roll shell.

In order that in suction rolls the production of the vacuum does not necessitate the expenditure of too much engery, it is known to provide in the interior of the suction roll an approximately circular sector-shaped suction box by means of which the vacuum is supplied only to the respective region of the roll shell becoming effective. It is usual in this case to provide sealing rails between the suction box and the circular-cylindrical inner surface of the roll shell, the rails also ensuring that the water sucked away travels into the suction box. Now in suction rolls of the kind referred to above the grid structure would lead to high wear of these sealing rails, for which reason the known suction roll according to the U.S. Pat. No. 3,139,375 has disposed therein between the suction box and the roll shell an insert which comprises a similar grid structure and which is to serve for sealing the suction box against the inner surface of the roll shell. However, it is obviously understood that a satisfactory seal cannot be attained therewith, unless excessive precision demands are made for the production.

In a second kind of known suction rollers the roll shell consists of a centrifugally cast tube of a bronze alloy or stainless steel which is provided with a large number of bores which extend in a radial direction and through which the paper or cardboard web can be relieved of water. The boring of such a tube requires an extremely high expenditure of time, since approximately 30% of the material must be removed thereby. Added thereto must be the fact that the centrifugally cast tubes must be machined not only on the outside, but also on the inside, in order to provide a satisfactory abutment surface for the sealing rails referred to. Thus these centrifugally cast roll shells are expensive for a plurality of reasons, and moreover they have a relatively high weight.

The invention is thus based on the object to provide a suction roll which can be produced more economically than a suction roll with a drilled centrifugally cast tube forming the roll shell, and which nevertheless permits just the effective region of the suction roll to be sealed from the suction box by means of sealing rails. Starting from a suction roll of the kind referred to above, this problem is solved according to the invention in that the inner surface of the roll shell is formed, at least in substance, by extrusion moulded insert members inserted in the grid openings, the insert members having ducts which lie in the grid openings and extend at least approximately in a radial direction. These insert members may be produced in large numbers relatively accurately and yet economically by an extrusion moulding process, in which case they will preferably be produced from a synthetic resin material, and — in comparison with the abutment surfaces of known suction rolls with roll shells of grid structure — they increase the abutment surface available for the sealing rails in such a manner that excessive wear of the sealing rails need not be feared. Since the ducts referred to may be produced during moulding of the insert members, all that is necessary is that thereafter the insert members are pressed into and/or adhesively secured in the grid openings, which obviously is not so time consuming by far as the drilling of the centrifugally cast tubes for the known suction rolls of the second kind. Moreover, compared with this state of the art, a suction roll according to the invention has the added advantage that for comparable stability it is substantially lighter. Finally the material costs also amount to only approximately ⅓ of the costs to be defrayed for suction rolls having a centrifugally cast tubular roll shell. The work-material for the insert members may be so selected that particularly satisfactory sliding properties of the inner surface of the roll shell are obtained with respect to the work material of the sealing rails.

When a separate insert member is inserted into each grid opening, the former may be flush on the inner surface of the roll shell with the strips forming the grid structure, so that a smooth and gap-free inner surface of the roll shell is presented to the sealing rails. Under some circumstances, however, it may alternatively be advantageous to connect together a plurality of insert members by means of bridges preferably formed thereon, these bridges then being disposed within the grid structure and forming, at least substantially, the inner surface of the roll shell. In a preferred constructional form of this kind of suction roll according to the invention the respective insert members associated with a ring-shaped region of the roll shell are connected together to an annular structure. It is then not necessary to manipulate separately each individual insert member, and moreover larger coherent regions are obtained on the inner surface of the roll shell.

Figure 4:
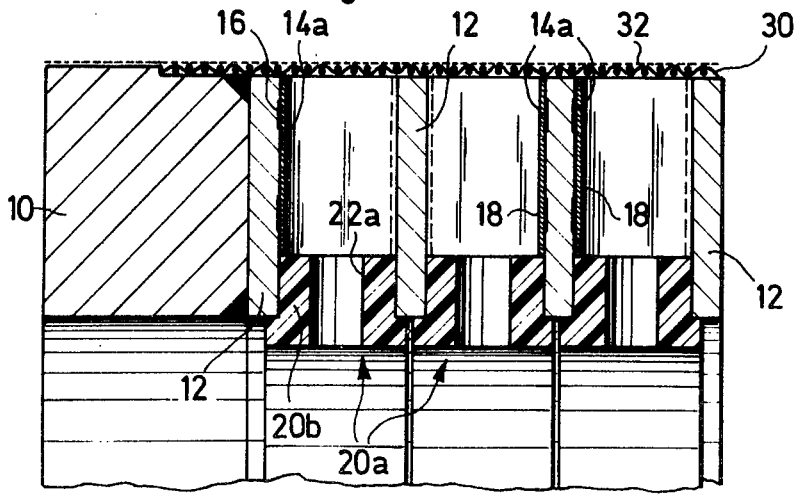
Figure 5:
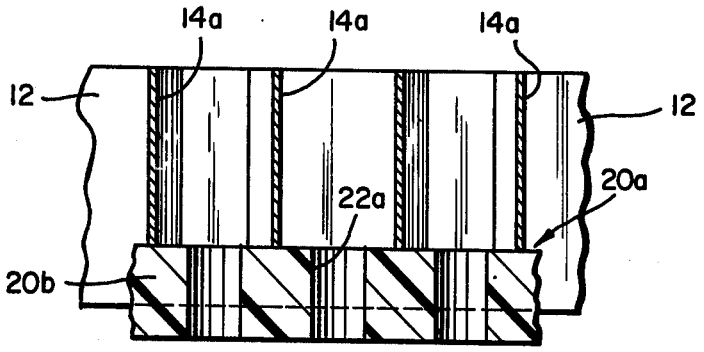

Further features, details and advantages of the invention result from the appended claims and/or from the following description and the accompanying graphic illustration of two preferred constructional forms of the invention. There are shown in:

FIG. 1 a view from above on an end region of a first constructional form of the suction roll according to the invention;

FIG. 2 a section on the line 2—2 in FIG. 1;

FIG. 3 an illustration corresponding to FIG. 1 of a second constructional form;

FIG. 4 a section on the line 4—4 in FIG. 3;

FIG. 5 a section on the line 5—5 in FIG. 3.

FIGS. 1 and 2 illustrate a circular ring-shaped end ring 10 which is to form the one front end of the suction roll; in FIG. 2 the direction of the axis of the suction roll is indicated at 11 by a dash-dotted line. In the same manner as in the roll according to the U.S. Pat. No. 3,105,043, the supporting structure of the roll shell is formed by sheet metal strips which either have the form of closed rings, or are of helical construction. The constructional examples shown have been illustrated in such a manner that the sheet metal strips are closed rings. The end ring 10 is followed first by a smooth ring 12 of a sheet metal strip standing on edge; this is followed at equal spacings in the axial direction by further such rings 12, all of which are formed from a relatively thick strip and receive between them so-called honeycomb rings 14 of a thinner corrugated sheet metal strip. At the locations denoted by 16 the smooth rings 12 are connected to the honeycomb rings 14, in particular by spot welding. In this way the supporting grid structure of the roll shell is produced. In FIGS. 1 and 2 this structure is continued to the right in a manner not illustrated in detail, and an end ring 10 is then located again at the right hand front end of the suction roll according to the invention. These end rings are likewise connected by welding to the outermost smooth rings 12.

Prior to the further assembly of the suction roll according to the invention the grid structure formed by the rings 12 and 14 may then be ground on the outside and on the inside to run round, so that the grid structure is rendered exactly circular-cylindrical inside and out.

In the constructional form according to FIGS. 1 and 2, a dowel-like insert member 20 of synthetic resin material, produced by an extrusion moulding process, is driven into each one of the grid openings 18 and under certain circumstances is additionally adhesively secured therein; as to its shape the insert member 20 is adjusted to the grid openings 18 and it is apertured with a longitudinal duct 22 with a countersunk outer end. The length of the insert members 20 corresponds to the height of the sheet metal strips from which the rings 12 and 14 are produced, so that a smooth, circular-cylindrical inner surface 24 results which forms an abutment face for sealing rails of a suction box not illustrated. Preferably the insert members 20 are provided on the periphery with an intermediate recessed region so that each insert member abuts at the top and at the bottom against the rings 12 and 14 merely by a collar 26. In this manner the insert members are particularly easy to insert, and yet they have a satisfactory fit in the grid openings 18.

When the suction roll according to the invention is not used in a long-filter paper machine, it is provided with a jacket of filter fabric material which may consist of a support fabric 30 and a finer cover fabric 32 for reducing marks in the paper web and for forming sheets. In a long-filter paper machine a travelling long filter takes the place of the filter fabric jacket. The fixing of the support fabric and the cover fabric on the suction roll body is effected in the usual manner.

Compared with the known roll with grid structure, the smooth rings 12 are more generously dimensioned, in order that the same stability results as in the known suction rolls with a roll shell produced from a centrifugally cast tube.

The constructional form according to FIGS. 3 and 4 differs only in two points from the embodiment according to FIGS. 1 and 2, so that only the differences must be discussed. These are to be seen in the fact that honeycomb rings **14*a* of reduced height have been used and that the place of the individual insert members 20 is taken by synthetic resin rings 20*a* which are formed unitarily with an insert member 20*b* for each grid opening 18, each insert member 20*b* having a duct 22*a* which extends also through the synthetic resin ring. Thus, as appears in FIG. 5, the synthetic resin rings form bridges which connect together the insert members 20*b*; they may consist of a plurality of segments, or they may be slit, in order that they can be inserted in the finished grid structure of the roll shell. As may be seen clearly from FIG. 4, the synthetic resin rings 20*a* abut from inside against the smooth rings 12, while the height of the insert members 20*b* is so dimensioned that the latter abut the inner edges of the honeycomb rings 14*a*. Thus in this embodiment the inside of the roll shell is formed exclusively by the inner surfaces of the synthetic resin rings 20*a***.

If it is desired to operate with larger tolerances, it is advantageous under certain circumstances to make the insert members 20 slightly longer than corresponds to the height of the rings 12 and 14; the roll shell is then turned or ground slightly on the inside and on the outside, in order to ensure an exactly circular-cylindrical shape. In the embodiment according to FIGS. 3 and 4, the height of the insert members **20*b* will be selected slightly greater in a corresponding manner than the spacing of the inner edges of the honeycomb rings 14*a* from the inner edges of the smooth rings 12**.

Preferably the insert members are provided with notches in order to attain that upon pressing into the honeycombs or grid openings they place themselves elastically against the walls thereof.

Having disclosed the invention, what is claimed and secured by Letters Patent is:

1. A paper-machine suction roll for use with a suction box and having a tubular grid structure forming a hollow cylindrical roll shell and having a cylindrical inner surface from which the suction box draws water, and having the improvement comprising insert members mountingly inserted into openings of said grid structure and apertured with radially-extending ducts, said insert members forming a major portion of said shell inner surface and characterizing said inner surface for relatively low-wear sealing with a suction box.

2. A suction roll according to claim 1 having the further improvement in which said insert members are moulded of synthetic resin material.

3. A suction roll according to claim 1 having the further improvement in which said insert members are press-fitted into the grid openings of said roll shell.

4. A suction roll according to claim 1 having the further improvement in which a separate one of said insert members is inserted in a single grid opening.

5. A suction roll according to claim 1 having the further improvement in which each insert member comprises a column-like configuration with a cross-section corresponding to the cross-section of the grid opening for closing the grid opening except at the duct extending through the insert member.

6. A suction roll according to claim 1 in which said grid structure includes an axially-extending alternate succession of at least a straight strip and a corrugated strip, said strips extending approximately in the peripheral direction of the roll shell and standing upright on one edge in a radial direction, and characterized in that said insert members are substantially flush with radially-inner edges of the grid-forming strips along said shell inner surface.

7. A suction roll according to claim 1 having the further improvement comprising a unitary structure of plural insert members interconnected by bridging means for simultaneous insertion into the roll shell, the interconnecting bridging means forming a portion of said shell inner surface.

8. A suction roll according to claim 7 having the further improvement in which said unitary structure is of annular shape for insertion into a ring-shaped region of the roll shell.

9. A suction roll according to claim 7 in which said grid structure includes an axially-extending alternate succession of at least a straight strip and a corrugated strip, said strips extending approximately in the peripheral direction of the roll shell and standing upright on one edge in a radial direction, and characterized in that said unitary structure abuts radially inner edges of the straight strip sections.

10. In a suction roll for a paper machine and for use with a suction box, the suction roll having a tubular grid structure forming a hollow cylindrical shell and having a cylindrical inner surface from which the suction box draws water, the improvement comprising means mountingly inserted in openings of the grid structure, said means having radially-extending passages for the suction of water through the roll shell to the roll shell inner surface, substantially closing at least a portion of said shell except at said radial passages, and forming at least a major portion of the roll inner surface for relatively low-wear sealing with a suction box movable relative to said inner surface.

* * * * *